United States Patent [19]

Kunstadter

[11] Patent Number: 4,878,879

[45] Date of Patent: Nov. 7, 1989

[54] CLOSURE DEVICE FOR NURSING BRA

[76] Inventor: Maria A. Kunstadter, 1708 Bluebell, Liberty, Mo. 64068

[21] Appl. No.: 292,108

[22] Filed: Dec. 30, 1988

[51] Int. Cl.[4] ..... A41C 03/04

[52] U.S. Cl. ..... 450/36; 2/104; 2/101; 2/271; 223/111

[58] Field of Search ..... 450/36, 31, 32, 54; 2/104, 101, 271; 223/11

[56] References Cited

U.S. PATENT DOCUMENTS

| | | | |
|---|---|---|---|
| 462,555 | 11/1891 | Hoyt | 2/101 |
| 1,664,214 | 3/1928 | Hudson | 2/104 X |
| 4,390,024 | 6/1983 | Williams | 450/36 |
| 4,640,287 | 2/1987 | Anderson et al. | 450/36 |
| 4,648,404 | 3/1987 | Clark | 450/31 |

*Primary Examiner*—Werner H. Schroeder
*Assistant Examiner*—Jeanette E. Chapman
*Attorney, Agent, or Firm*—Hovey, Williams, Timmons & Collins

[57] ABSTRACT

A simple yet extremely effective closure device for a nursing bra is provided which enables a nursing mother to quickly and inconspicuously close a cup on a nursing bra. The closure device includes an elongated flexible strip which is provided with a cup attachment clip at one end thereof, a stop at the other end, and a clip for attaching the strip to a bra strap intermediate the two ends. The bra strap clip is configured to enable the strip to slide relative to the bra strap, so that by pulling on the stop, the cup may be lifted into position for attachment by suitable snaps or the like.

5 Claims, 1 Drawing Sheet

CLOSURE DEVICE FOR NURSING BRA

BACKGROUND OF THE INVENTION

1. Field of the Invention

This invention relates to a closure device for a nursing bra of simple yet highly effective construction which enables the nursing mother to quickly and inconspicuously draw up the cup of a nursing bra after nursing an infant. In particular, it enables the nursing mother to cradle the infant with one arm while drawing up the breast-covering cup from a position proximate her shoulder. The closure device hereof is economical to construct and easy to attach, having an added advantage of being small and easy to conceal under the clothing of the wearer. More particularly, the invention is concerned with a flexible strip or ribbon having a clip at one end and a stop at the other, with a clip for attaching to the bra strap located intermediate the two ends so that the top of the cup of the bra may be drawn upwardly by sliding the strip relative to the draw strap.

2. Description of the Prior Art

Breast feeding has enjoyed a resurgency among nursing mothers because of the obvious nutritional benefits to the child as well as the emotional bonding between the mother and infant. As is commonly the practice, nursing mothers wear what is known as a nursing bra, which includes a flexible, foldable cup which may be lowered to enable the infant to have access to the nipple of the mother. After nursing is completed, the mother raises the cup and reattaches it to the support member of the nursing bra so that the cup will remain in breast covering position for normal wear. Typically, the mother cradles a child with one arm, holding the infant to her bosom and, at the same time, wearing an outer garment which permits the mother to give access to her breast. The nursing bra typically includes a snap or other closure at the top portion of the cup which is manually reattached to the strap or supporting device. The mother may either chose to permit the child to nurse in public view, with a portion of her clothing covering her breast, or, alternatively, withdraw to some more private setting.

In any event, the mother invariably encounters a problem when nursing is completed. She must often reach far down into her garment in order to grasp the top of the cup with one arm while cradling the child with the other. This may prove cumbersome or even impossible, necessitating putting the child down in order to reach the top of the cup for refastening it to the remainder of the bra. At best, this procedure is inconvenient, and at worst, may prove unsafe in that the mother may have to place the child down in a public area which may be somewhat unsanitary or be unable to prevent the child from tumbling off a bench or seat on which it is placed. Fumbling to locate the cup and reattach it to the bra is an annoyance which most nursing mothers would prefer to avoid, and, if nursing in public, it is difficult to reposition the cup near the fastener and remain discrete and unexposed.

SUMMARY OF THE INVENTION

The problems outlined above are in large measure solved by the closure device in accordance with the present invention. That is to say, the closure device hereof is economical to construct and thus represents an inexpensive addition for the nursing mother, may be reattached to different nursing bras as each bra needs to be washed, and enables the mother to easily, quickly and inconspicuously draw up the top of the cup of the nursing bra in close proximity to her shoulder for reattachment without reaching far down into her blouse to locate and reattach the top of the cup.

The closure device in accordance with the present invention is designed to be used in conjunction with a conventional nursing bra which includes a supporting structure, usually including a bra strap for supporting the cup in an upright, closed position. The closure device itself includes an elongated, flexible strip presenting two opposed ends. A first end is provided with an attachment for securing the strip to the top of the cup, while the second, opposed end is provided with a stop. Located intermediate these two ends is a clip in slidable engagement with the ribbon for attaching to the bra strap. By attaching the first end to the top of the cup and the bra strap attachment to the bra strap, the wearer may draw the top of the cup upwards so that the cup, which normally has a fastener at the top thereof, may be easily secured to the cup supporting structure.

In particularly preferred forms, a clip is attached at the first end of the flexible strip, which is preferably a fabric ribbon. The ribbon may be sewn over the clip which presents an opening therein for removably attaching the first end to the top of the bra cup. A similar cup is located intermediate the two ends, for releasably securing the ribbon to the bra strap. The stop on the second, opposed end inhibits and prevents the ribbon from passing through the bra strap attaching clip, allowing the closure device, the ribbon thus preventing the top of the cup from slipping to an undesirably low position.

DESCRIPTION OF THE PREFERRED EMBODIMENT

Figure 3:
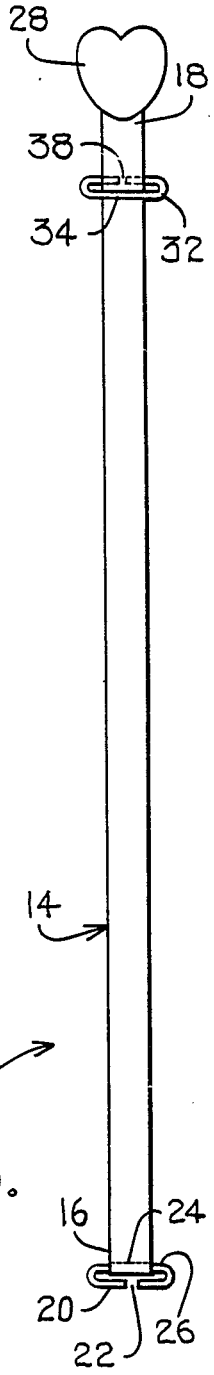
FIG. 3 is a front elevational view of the closure device hereof, showing the stop means, cup attaching clip and bra strap attaching clip on the strip.

Referring now to the drawing, a closure device 10 for a nursing bra 12 in accordance with the invention broadly includes an elongated, flexible, thin strip 14 which carries a pair of clips for attachment to the bra 12. Referring to FIG. 3, the strip 14 is preferably a thin fabric ribbon presenting two opposed ends 16, 18.

A metal, cup-attachment clip 20 of substantially rectangular or oval configuration and presenting an access opening 22 opposite the strip 14 is attached by stitching 24 where the ribbon 14 loops around the bight 26 of the cup attaching clip 20. Thus, the cup attaching clip is fixably secured at the first end 16 of the ribbon 14 and will not slide along the ribbon toward second end 18.

Second end 18 includes a stop 28 which is attached to the ribbon by any suitable means such as adhesive, Velcro fasteners, or stitching. Preferably, the stop 28 is a piece of fabric embroidery which may be attached by stitching 30 and is of sufficient size to prevent end 18 from being pulled through bra strap attaching clip 32.

Figure 2:
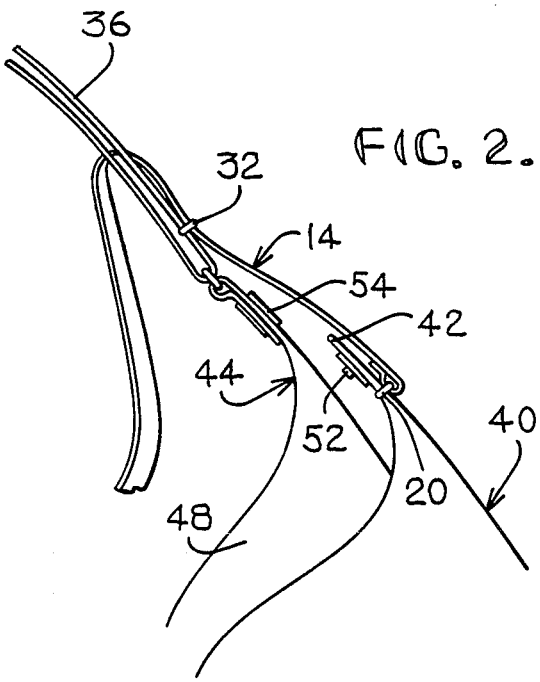
FIG. 2 is an enlarged, partial side elevational view showing the closure device hereof with the cup drawn upwardly prior to fastening to the supporting structure.

Bra strap attaching clip 32 is also a rectangular or substantially oval shaped member having a bight 34 of slightly greater width than ribbon 14 and a depth sufficient to accommodate ribbon 14 and a fabric bra strap such as is shown in FIG. 2. An access opening 38 is positioned bight 34 for enabling the bra strap attaching clip to be secured to bra strap 36.

The closure device hereof is adapted to be used with a conventional nursing bra 12 which has cups 40 presenting a top portion 42 for attachment to supporting structure 44 of the bra 12. The supporting structure 44 may include bra straps 36 and back strap 46, as well as breast suspender 48. Cup 40 is preferably of a flexible, fabric member, while supporting structure 44 may have a degree of elasticity by incorporating resilient rubber threads therein to permit adequate support for the female breast protruding through opening 50 defined by breast suspender 48.

Yet further, it will be appreciated that in order to maintain the cup in breast covering position, the cup and supporting structure will ordinarily include complementary closure devices such as snap 52 on top portion 42 of cup 40 and snap receiver 54 on supporting structure 44. It may be appreciated that various types of closure devices may be employed, including not only snaps but also Velcro attachments, hooks, and clasps, among others. For this reason, the depth of cup attaching clip 20 as shown in FIG. 2 is sufficient to receive the top portion 42 of cup 40 therein through opening 22 but insufficient to permit snap 52 or other attaching means on top 40 from sliding through the cup attaching clip 20. Thus, the snap 52 or other attaching device will engage cup attaching clip 20 and prevent top portion 42 from sliding therethrough.

Similarly, snap receiver 54 or other complementary attaching device may be positioned either on breast suspender 48 or bra strap 36 so that cup 40 may be secured in a closed position. As shown herein, the snap receiver 54 is located on breast suspender 48, with bra strap attaching clip 32 positioned vertically thereabove for drawing the top portion 42 vertically. Bra strap attaching clip 32 is of sufficient depth to permit ribbon 14 to pass therethrough and to secure to bra strap 36.

Figure 1:
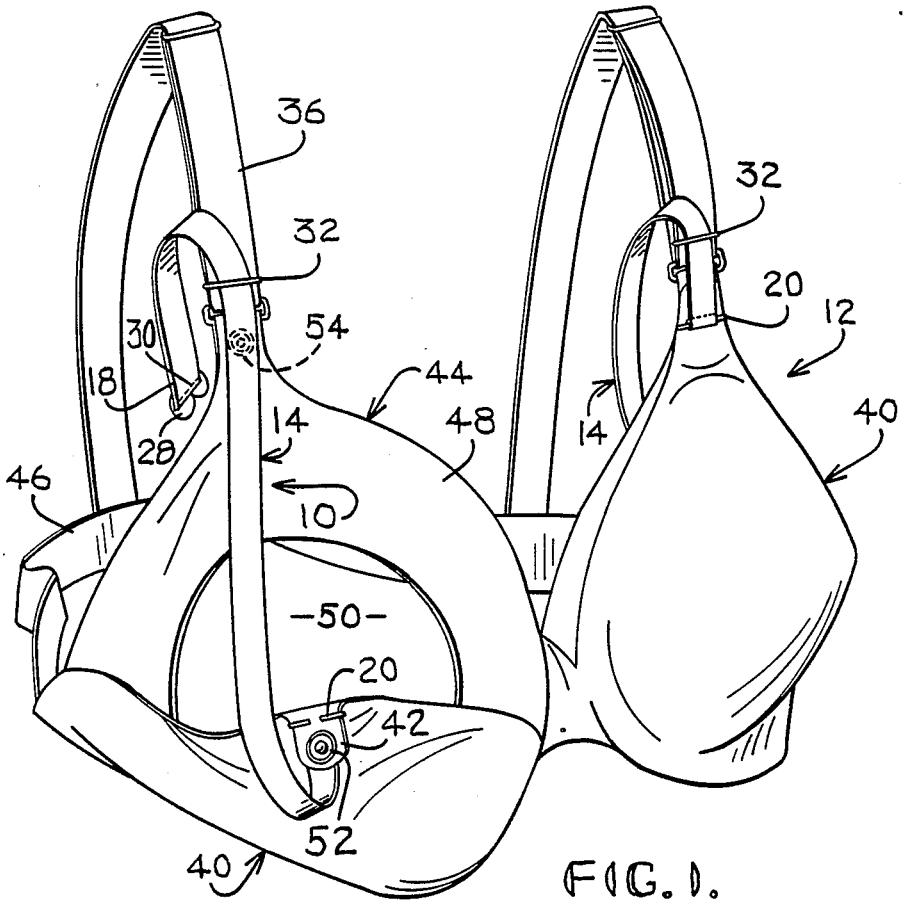
FIG. 1 is a perspective view of a nursing bra showing the closure device attached thereto, with one of the cups of the bra lowered and the other cup fastened to the cup supporting structure.

It is to be understood that while ribbon 14 may limit the cup from falling downwardly beneath the bra 12, it is of sufficient length to enable cup 40 to drop far enough that the female breast within an opening 50 is fully exposed and that top portion 42 does not obstruct the nursing evolution. When nursing is completed, the mother need only grasp stop 28 and draw ribbon 14 upward to pull top portion 42 into position so that snap 52 may be located adjacent snap receiver 54. Because bra strap attaching clip 32 is above snap receiver 54, top portion 42 may be drawn upwardly a sufficient distance so that snap 52 is in complete registry with snap receiver 54. It may also be appreciated that the device hereof acts not only as a vertical positioning device but also positions the snaps horizontally to place the snap 52 and snap receiver 54 in approximate registry when the user pulls on stop 28. It may also be appreciated that only one hand is necessary to draw the ribbon 14 upwardly and thus enable cup 40 to cover the female breast. When the snaps or other closure devices are in approximate registry, the stop may be released so that again, through one handed operation, the mother may reattach the cup 40 to the supporting structure 44. Once snapped, as is shown on the right side in FIG. 1, the ribbon 14 may be tucked behind breast suspender 48 and cup 40 to remain inconspicuous until use is again desired.

It may be appreciated that the preferred embodiment as disclosed herein may be removed from a nursing bra when it is necessary to launder it. Thus, a single pair of straps may be used on multiple nursing bras when the releasable clips 22 and 32 are used as shown in this embodiment.

Although I have shown and described a specific embodiment of my invention, it will be readily apparent that many minor changes of structure and operation could be made without departing from the spirit of the invention. What I claim as new and desire to protect by Letters Patent is:

1. A closure device for a nursing bra having a releasably securable breast-enveloping cup and a supporting bra strap, said closure device comprising:

an elongated flexible strip presenting a first end and a second end;

means for releasably attaching the strip to the cup at said first end;

means for releasably attaching the strip to the bra strap and for enabling the strip to move slidably relative to the bra strap, said attaching means being positioned intermediate the first end and the second end; and stop means attached to the second end for inhibiting the second end from sliding through said bra strap attaching means.

2. A closure device as set forth in claim 1 wherein said cup attaching means and said bra strap attaching means comprise clips, each clip presenting an access opening therein.

3. A nursing bra including at least one foldable, front breast covering cup, for supporting said cup, and means on said cup for releasably attaching said cup to said support member, wherein the improvement comprises means releasably attached to said cup and connected to said support means for lifting said cup from a location proximate said bra strap.

4. A nursing bra as set forth in claim 3, wherein said lifting means comprises an elongated flexible strip presenting first and second ends, said first end being secured to said cup and a means intermediate said first and second end for attaching said strip to said bra strap for permitting relative movement therebetween, and stop means attached to said second end for inhibiting said strip from passing through said bra strap attaching means.

5. A nursing bra as set forth in claim 4, wherein said first end of said strip is releasably secured to said cup below said cup attaching means.

* * * * *